US011128069B2

(12) United States Patent
Yagyu

(10) Patent No.: US 11,128,069 B2
(45) Date of Patent: Sep. 21, 2021

(54) ELECTRONIC DEVICE AND PRESS-FIT TERMINAL

(71) Applicant: DENSO CORPORATION, Kariya (JP)

(72) Inventor: Yuki Yagyu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/804,689

(22) Filed: Feb. 28, 2020

(65) Prior Publication Data

US 2020/0287305 A1 Sep. 10, 2020

(30) Foreign Application Priority Data

Mar. 8, 2019 (JP) ..... JP2019-042618

(51) Int. Cl.
*H01R 12/58* (2011.01)
*H01R 13/03* (2006.01)

(52) U.S. Cl.
CPC ..... *H01R 12/585* (2013.01); *H01R 13/03* (2013.01)

(58) Field of Classification Search
CPC ..... H01R 12/585
See application file for complete search history.

(56) References Cited

U.S. PATENT DOCUMENTS 7,008,272 B2 * 3/2006 Blossfeld ..... H01R 12/585 439/751
9,634,412 B2 * 4/2017 Uzoh ..... H05K 3/4007
2019/0312367 A1 10/2019 Yagyu
2020/0251836 A1 * 8/2020 Yoshida ..... H01R 12/58

FOREIGN PATENT DOCUMENTS

JP 2007-042358 A 2/2007
JP 2018-073707 A 5/2018

OTHER PUBLICATIONS https://en.wikipedia.org/wiki/Hardnesses_of_the_elements_(data_page), retrieved Dec. 10, 2020 (Year: 2020).*

* cited by examiner

*Primary Examiner* — Ross N Gushi
(74) *Attorney, Agent, or Firm* — Posz Law Group, PLC

(57) ABSTRACT

An electronic device includes a press-fit terminal and a recess. The press-fit terminal includes a bar portion and a press-fit deformation portion. The press-fit deformation portion is provided at an end of the bar portion. The press-fit deformation portion is deformed when inserted into an insertion hole of a circuit board. The recess is provided in the press-fit deformation portion and recessed from a surface of the press-fit deformation portion.

6 Claims, 9 Drawing Sheets

ELECTRONIC DEVICE AND PRESS-FIT TERMINAL

CROSS REFERENCE TO RELATED APPLICATION

The present application claims the benefit of priority from Japanese Patent Application No. 2019-42618 filed on Mar. 8, 2019. The entire disclosure of the above application is incorporated herein by reference.

TECHNICAL FIELD

The present disclosure relates to an electronic device and a press-fit terminal.

BACKGROUND

When a terminal is electrically connected to a through hole of a circuit board, soldering connection was used. Due to restriction on the use of lead, a configuration that does not use solder has been employed.

SUMMARY

The present disclosure provides an electronic device and a press-fit terminal. The electronic device includes the press-fit terminal. The press-fit terminal includes a bar portion and a press-fit deformation portion. The press-fit deformation portion is provided at an end of the bar portion. The press-fit deformation portion is deformed when inserted into an insertion hole of a circuit board.

BRIEF DESCRIPTION OF DRAWINGS

The features and advantages of the present disclosure will become more apparent from the following detailed description made with reference to the accompanying drawings. In the drawings.

DETAILED DESCRIPTION

Figure 1:
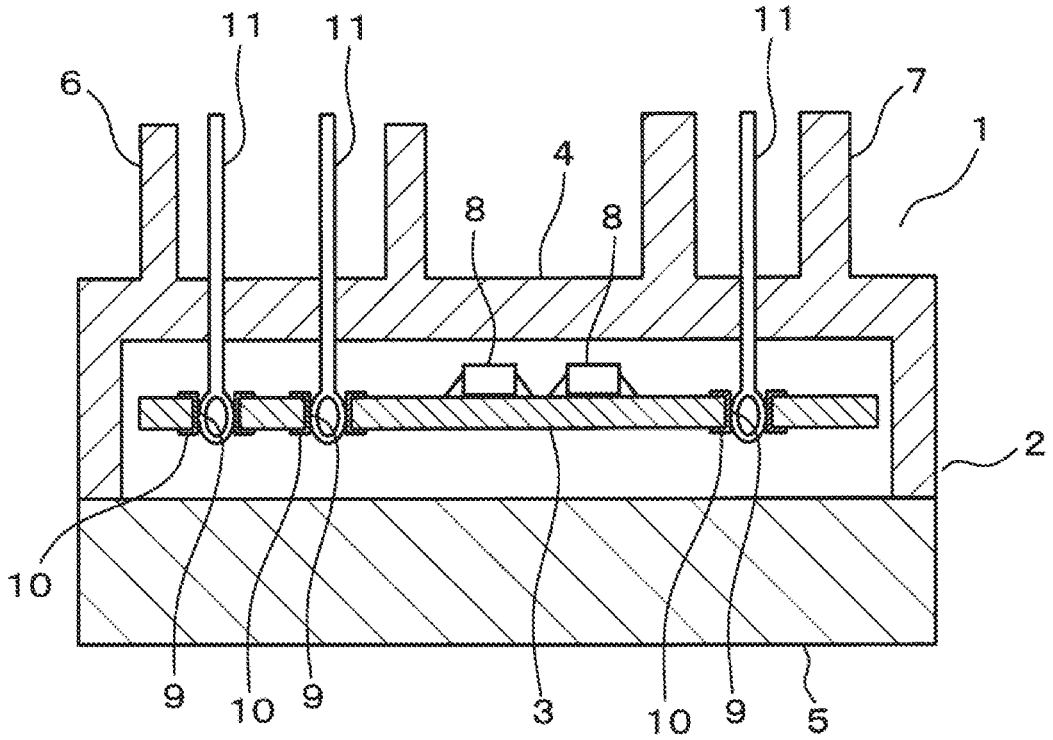
FIG. 1 is a vertical cross-sectional view showing an electronic device according to a first embodiment.

As an example of a terminal that does not use solder, a press-fit terminal is employed. The press-fit terminal is electrically connected and mechanically fixed to a through hole by being pressed into the through hole. The press-fit terminal, for example, is made of a copper alloy, and the surface of the press-fit terminal is tin-plated. The terminal width of the press-fit terminal is greater than the width of the through hole. Thus, a mechanically fixing force can be obtained when the press-fit terminal is pressed into the through hole.

The tin plating on the surface of the press-fit terminal is softer than the copper plating formed on the surface of the through hole. When the terminal is pressed into the through hole, the tin plating on the terminal surface may wear out and generate conductive plating debris. When the plating debris is generated, there is a possibility that conduction failure occurs in the circuit board.

As a measure to reduce the generation of plating debris, the tin plating is made thinner in a region where a large contact load is applied when the terminal is pressed into the through hole and is made thicker in the other region in consideration of the reliability of the electrical connection. In this configuration, it is necessary to change the thickness of the tin plating in a narrow region of the fine terminal, so that the plating is technically difficult and the plating process is complicated.

As another measure, the entire press-fit terminal is plated to have the same plating thickness, that is, an appropriate plating thickness that does not generate plating debris but ensures electrical connection reliability. In this configuration, stable mass production is difficult because the range for management of the plating thickness is small.

The present disclosure provides an electronic device and a press-fit terminal each capable of reducing generation of plating debris when the press-fit terminal is pressed into a through hole, and capable of being easily manufactured.

An example embodiment of the present disclosure provides an electronic device. The electronic device includes a circuit board, a press-fit terminal, a recess, and a terminal-side conductor layer. The press-fit terminal is inserted into a through hole of the circuit board. The press-fit terminal includes a bar portion and a press-fit deformation portion. The press-fit deformation portion is provided at an end of the bar portion. The press-fit deformation portion is wider than the through hole in a deformation direction. The press-fit deformation portion is deformed when inserted into the insertion hole. The recess is provided in the press-fit deformation portion and recessed from a surface of the press-fit deformation portion. The terminal-side conductor layer is a plating smoothly covering the surface of the press-fit deformation portion including the recess without depression.

Another example embodiment of the present disclosure provides a press-fit terminal. The press-fit terminal is to be inserted into a through hole of a circuit board. The press-fit terminal includes a bar portion, a press-fit deformation portion, a recess, and a terminal-side conductor layer. The press-fit deformation portion is provided at an end of the bar portion, wider than the through hole in a deformation direction, and to be deformed when inserted into the insertion hole. The recess is provided in the press-fit deformation portion and recessed from a surface of the press-fit deformation portion. The terminal-side conductor layer is a plating smoothly covering the surface of the press-fit deformation portion including the recess without depression.

First Embodiment

The first embodiment of the present disclosure will be described with reference to FIGS. 1 to 10. The electronic device according to the present embodiment may be mounted on a vehicle, and provided as an ECU (electronic control unit) that controls the vehicle. As shown in FIG. 1, the electronic device 1 includes a housing 2 and a circuit board 3 accommodated in the housing 2.

The housing 2 includes a housing case 4 made of, for example, resin, and a cover 5 made of, for example, resin or metal, which closes an opening of the housing case 4. Connectors 6 and 7 are formed on an upper surface of the housing case 4 in FIG. 1.

Figure 2:
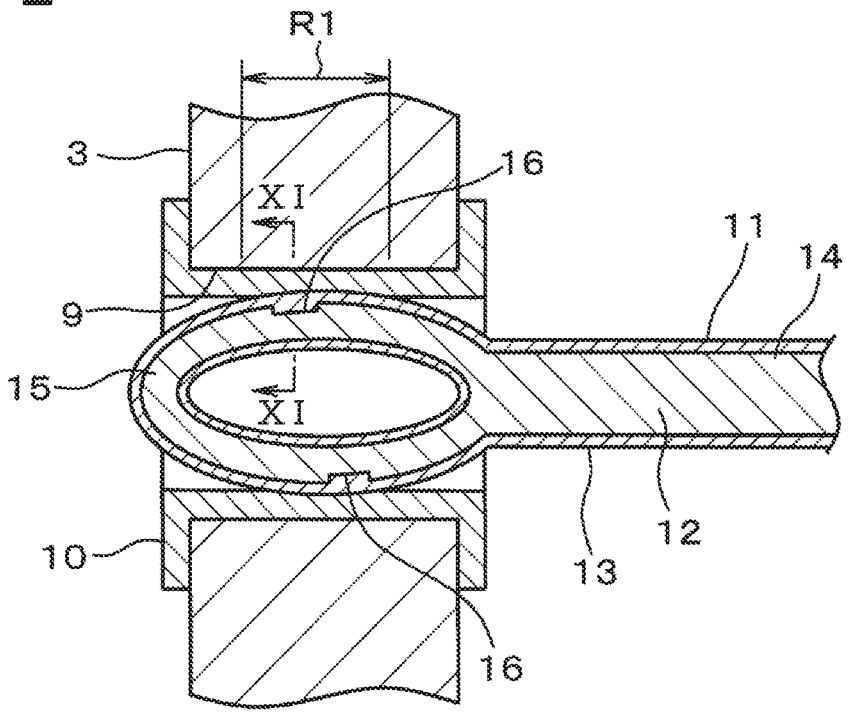
FIG. 2 is an enlarged vertical cross-sectional view showing a state in which a press-fit terminal is pressed into a through hole.

On the circuit board 3, an electronic component 8 and the like are mounted, a wiring pattern (not shown) is formed, and a through hole 9 is formed. As shown in FIG. 2, a copper plating layer 10 may be formed on an inner peripheral surface and an edge of the opening of each through hole 9. The copper plating layer 10 is provided by a through-hole-side conductor layer.

A press-fit terminal 11 is inserted into the through hole 9. The press-fit terminal 11 includes a terminal base material 12 made of, for example, copper or a copper alloy. A tin plating layer 13 may be formed on the entire surface of the terminal base material 12. The tin plating layer 13 is provided by a terminal-side conductor layer.

Figure 3:
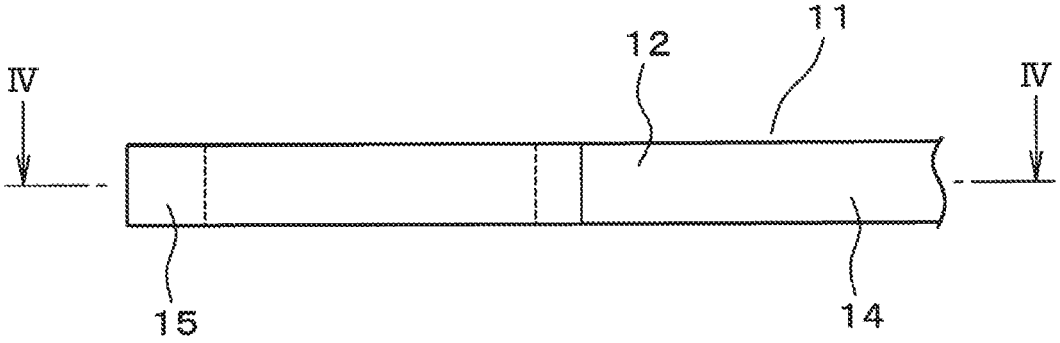
FIG. 3 is a partial side view showing the press-fit terminal.
Figure 4:
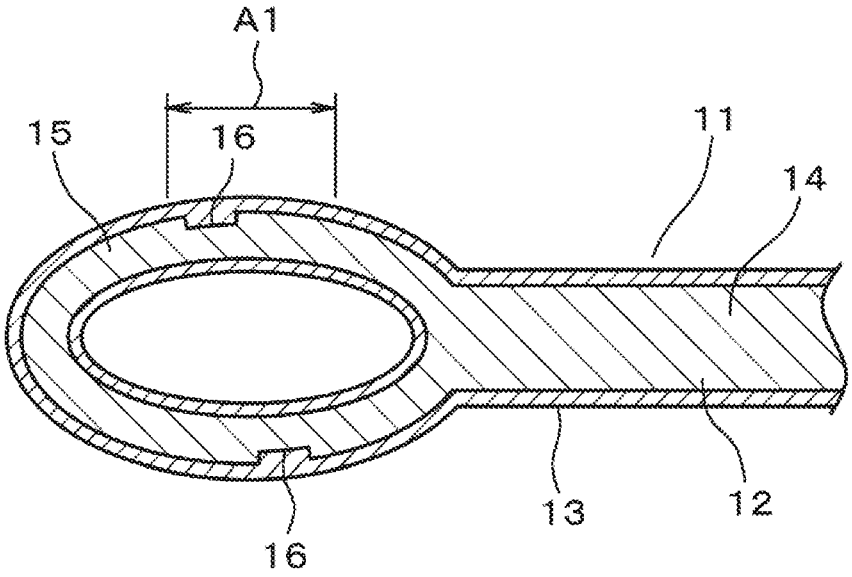
FIG. 4 is a cross-sectional view taken along line IV-IV in FIG. 3.

As shown in FIGS. 3 and 4, the terminal base material 12 of the press-fit terminal 11 includes a terminal body 14 and a terminal insertion portion 15. The terminal body 14 may have a plate shape elongated in an insertion direction. The terminal insertion portion 15 has a needle eye shape at the tip of the terminal body 14, that is, at the left end of the terminal body 14 in FIG. 4. The terminal insertion portion 15 is wider than the through hole in a deformation direction. The terminal main body 14 is referred to as a bar portion and the terminal insertion portion 15 is referred to as a press-fit deformation portion. The terminal insertion portion 15 is press-fitted into the through hole 9 and deformed, and electrically connected to the copper plating layer 10 of the through hole 9 by a reaction force due to the deformation.

Figure 5:
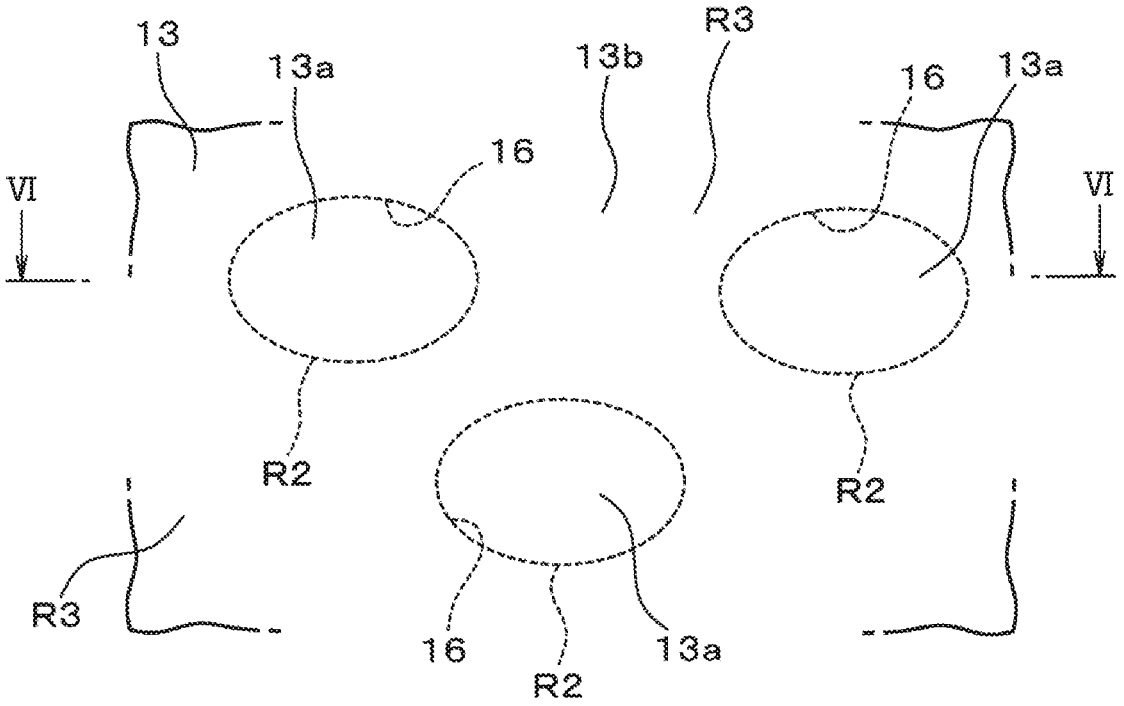
FIG. 5 is a partial view showing a surface of a terminal insertion portion of the press-fit terminal.
Figure 6:
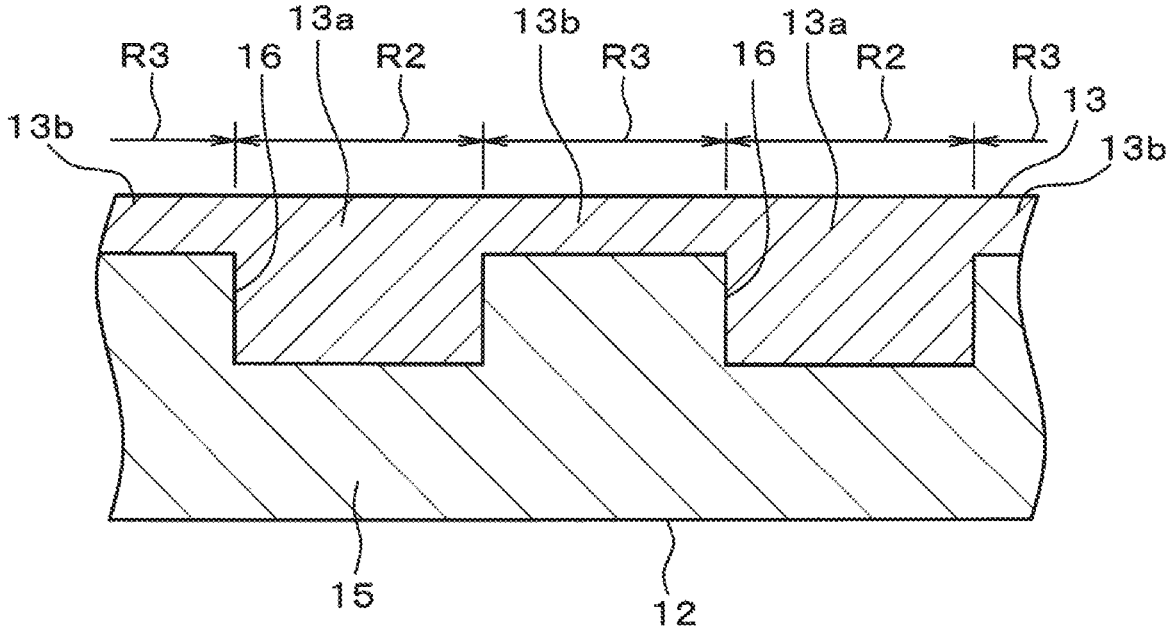
FIG. 6 is a cross-sectional view taken along line VI-VI in FIG. 5.

At least one recess 16 is formed in a region of the surface of the terminal insertion portion 15 which is in contact with the inner peripheral surface of the through hole 9, that is, in a region R1 shown in FIGS. 2 and 4. As shown in FIGS. 5 and 6, the recess 16 has the opening with, for example, an elliptical shape or a circular shape.

In the present embodiment, the tin plating layer 13 of the press-fit terminal 11 is thick in a region R2 and thin in a region R3. In the region R2, the tin plating layer 13 is embedded in the recess 16. A first tin plating layer 13*a* of the tin plating layer 13 corresponding to the region R2 is softer than the copper plating layer 10 in the through hole 9. The first tin plating layer 13*a* referred to as a first metal portion. The region R3 is a region other than the region R2 in the tin plating layer 13. A second tin plating layer 13*b* of the tin plating layer 13 corresponding to the region R3 other than the region R2 is harder than the copper plating layer 10 in the through hole 9. The second tin plating layer 13*b* referred to as a second metal portion.

The second tin plating layer 13*b* formed on the surface of the tip of the terminal insertion portion 15, that is, the surface of the region R3 other than the region R2 corresponding to the recess 16 is harder than the copper plating layer 10 of the through hole 9. The terminal insertion portion 15 at the tip of the press-fit terminal 11 may be inserted, that is, press-fitted into the through hole 9. In this case, even when the terminal insertion portion 15 and the inner peripheral surface of the through hole 9 rub against each other, wear debris of the tin plating layer 13 of the terminal insertion portion 15 is less likely generated. In the region R1 where the terminal insertion portion 15 and the inner peripheral surface of the through hole 9 are in contact with each other, the first tin plating layer 13*a* is softer than the copper plating layer 10 of the through hole 9. Thus, the terminal insertion portion 15 and the through hole 9 are connected to each other with good electrical connectivity.

Here, a method for producing the first tin plating layer 13*a* and the second tin plating layer 13*b* will be described with reference to FIGS. 7A to 7C.

Figure 7A:
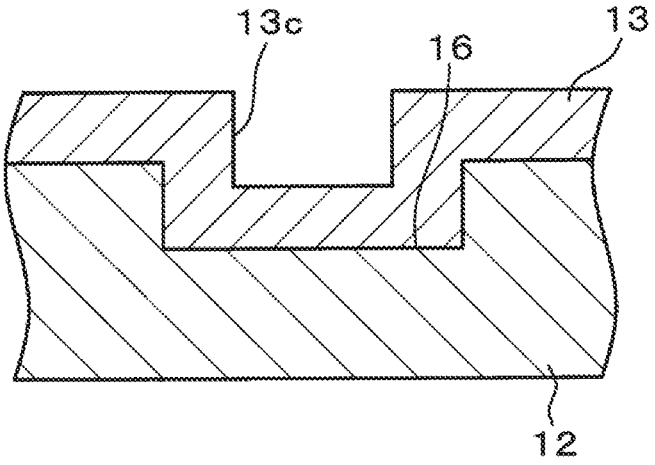
FIG. 7A is a diagram showing a first manufacturing process of the press-fit terminal after plating process is finished.
Figure 7B:
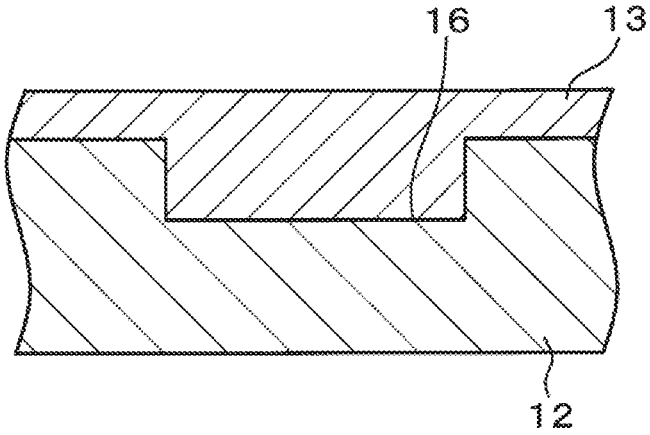
FIG. 7B is a diagram showing the first manufacturing process of the press-fit terminal in heat treatment.
Figure 7C:
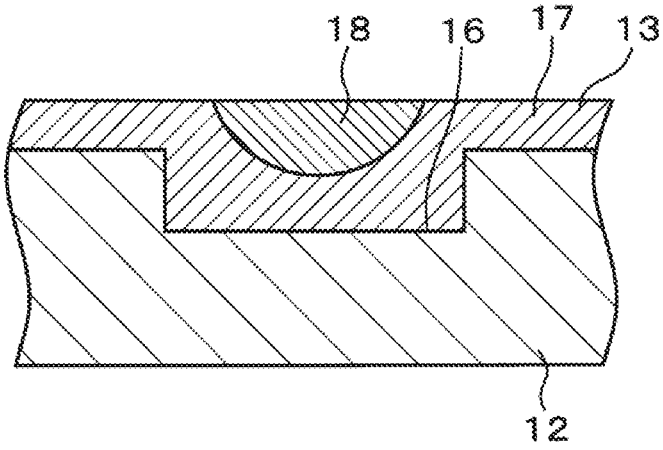
FIG. 7C is a diagram showing the first manufacturing process of the press-fit terminal after heat treatment is finished.

First, as shown in FIG. 7A, the recess 16 is formed in the terminal base material 12 of the press-fit terminal 11, and the tin plating layer 13 is formed on the entire surface of the terminal base material 12. In this case, as tin plating, non-glossy tin plating that covers the terminal base material 12 with the tin plating layer 13 having a uniform thickness is performed. The tin plating layer 13 is formed along the inner surface of the recess 16, and the tin plating layer 13 has a recess 13*c* corresponding to the recess 16.

Heat treatment is performed on the terminal base material 12 and the tin plating layer 13 in the state shown in FIG. 7A. As shown in FIG. 7B, the tin plating is melted by the heat treatment and fills the recess 16 of the terminal base material 12 by the surface tension. Thus, the tin plating layer 13 having a smooth surface is performed. When the heat treatment is completed, as shown in FIG. 7C, the tin plating and a base material such as copper or nickel are interdiffused. The treatment forms a tin alloy 17 made of a tin and copper alloy or a tin and nickel alloy, for example. At this time, a pure tin 18 that has not been alloyed exists in the recess 16 of the terminal base material 12. The tin alloy 17 is harder than the copper plating layer 10 in the through hole 9, and the pure tin 18 is softer than the copper plating layer 10 in the through hole 9. Thus, the press-fit terminal 11 in which the first tin plating layer 13*a* in the region R2 is made softer than the copper plating layer 10 in the through hole 9, and the second tin plating layer 13*b* in the region R3 other than the region R2 is made harder than the copper plating layer 10 in the through hole 9 can be manufactured.

Figure 8A:
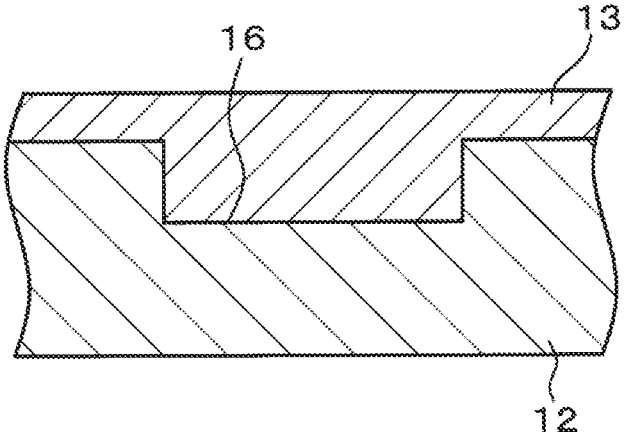
FIG. 8A is a diagram showing a second manufacturing process of the press-fit terminal after plating process is finished.

Another method for producing the first tin plating layer 13*a* and the second tin plating layer 13*b* will be described with reference to FIGS. 8A to 8C. The recess 16 is formed in the terminal base material 12. In this method, glossy tin plating that covers the terminal base material 12 with the tin plating layer 13 having a uniform thickness is performed. The tin plating layer 13 is formed on the entire surface of the terminal base material 12. As shown in FIG. 8A, the surface of the terminal base material 12 is covered with the smooth tin plating layer 13 even when the recess 16 is formed in the terminal base material 12.

Figure 8B:
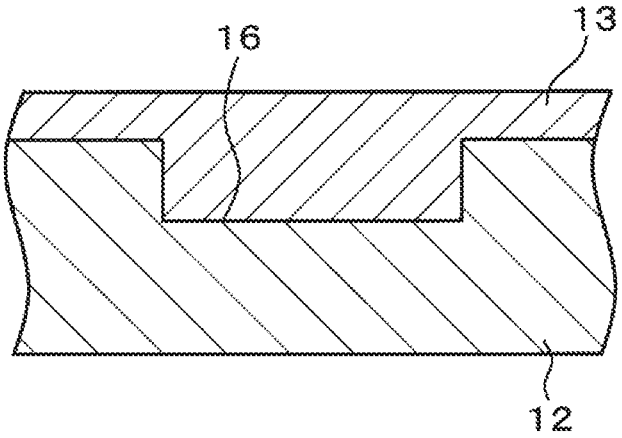
FIG. 8B is a diagram showing the second manufacturing process of the press-fit terminal in heat treatment.
Figure 8C:
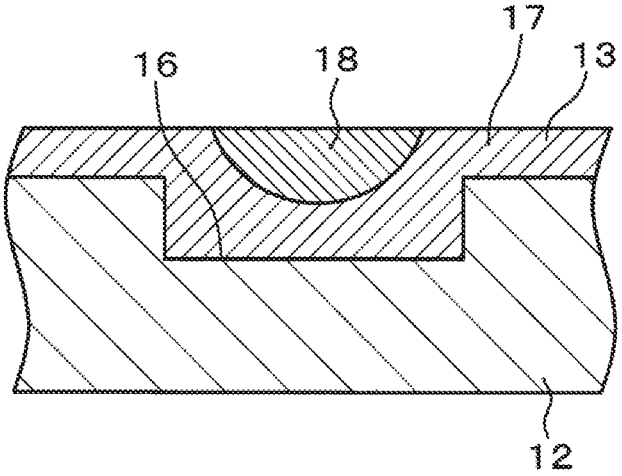
FIG. 8C is a diagram showing the second manufacturing process of the press-fit terminal after heat treatment is finished.

As shown in FIG. 8B, the heat treatment is performed to the terminal base material 12 and the tin plating layer 13. When the heat treatment is completed, as shown in FIG. 8C, the tin plating and the base material such as copper or nickel are interdiffused. The treatment forms the tin alloy 17 made of the tin and copper alloy or the tin and nickel alloy, for example. At this time, the pure tin 18 that has not been alloyed exists in the recess 16 of the terminal base material 12. Thus, the first tin plating layer 13*a* in the region R2 is made softer than the copper plating layer 10 in the through hole 9, and the second tin plating layer 13*b* in the region R3 is made harder than the copper plating layer 10 in the through hole 9 can be manufactured.

Figure 9A:
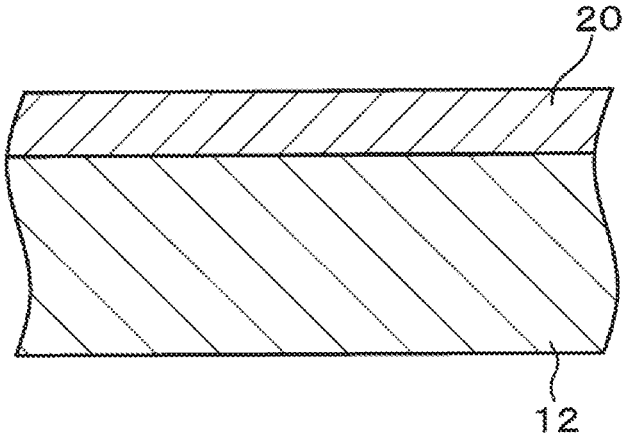
FIG. 9A is a diagram showing a manufacturing process of the press-fit terminal of a first comparative example after plating process is finished.
Figure 9B:
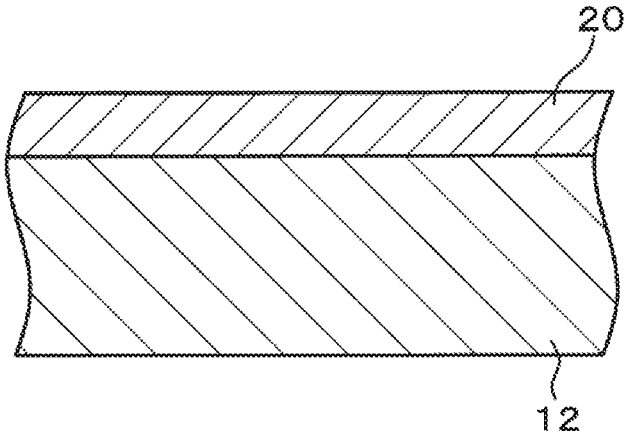
FIG. 9B is a diagram showing the manufacturing process of the press-fit terminal of the first comparative example in heat treatment.
Figure 9C:
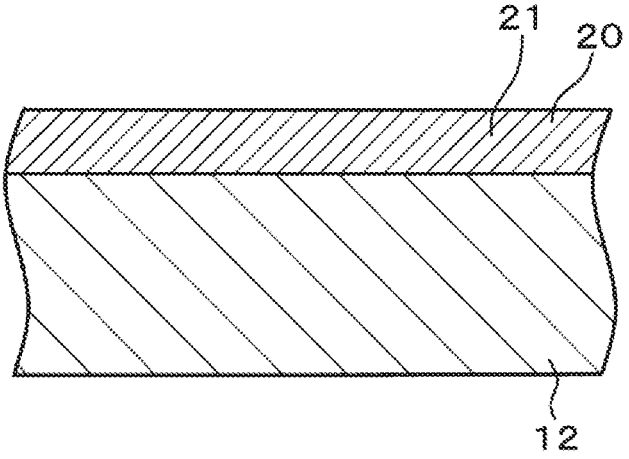
FIG. 9C is a diagram showing the manufacturing process of the press-fit terminal of the first comparative example after heat treatment is finished.

As a first comparative example, FIGS. 9A and 9C show an example in which a thin tin plating layer 20 is formed on the surface of the terminal base material 12 that has no recess. As shown in FIG. 9C, when the heat treatment is completed, the tin alloy 21 is formed by the interdiffusion of the thin tin plating layer 20 and the base material. When the press-fit terminal having such a configuration is pressed into the through hole, no plating debris is generated because the tin alloy 21 is hard. However, the electrical connection may be poor.

Figure 10A:
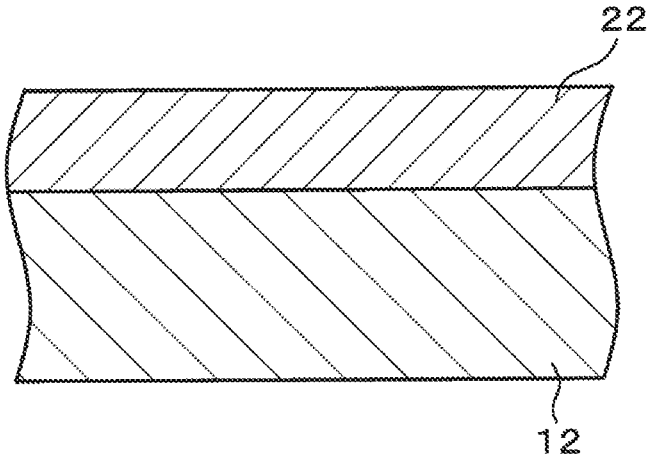
FIG. 10A is a diagram showing a manufacturing process of the press-fit terminal of a second comparative example after plating process is finished.
Figure 10B:
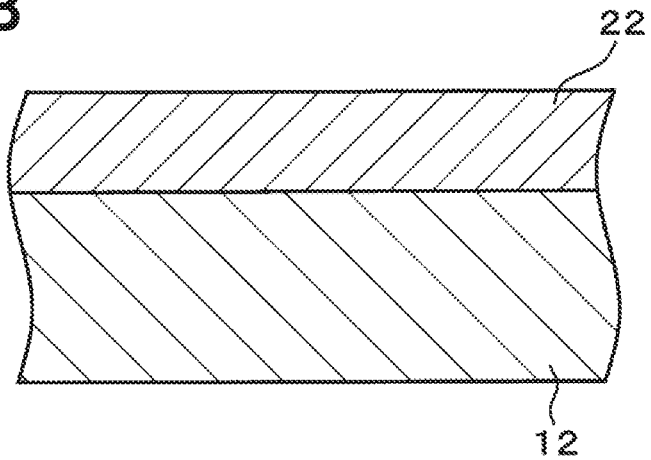
FIG. 10B is a diagram showing the manufacturing process of the press-fit terminal of the second comparative example in heat treatment.
Figure 10C:
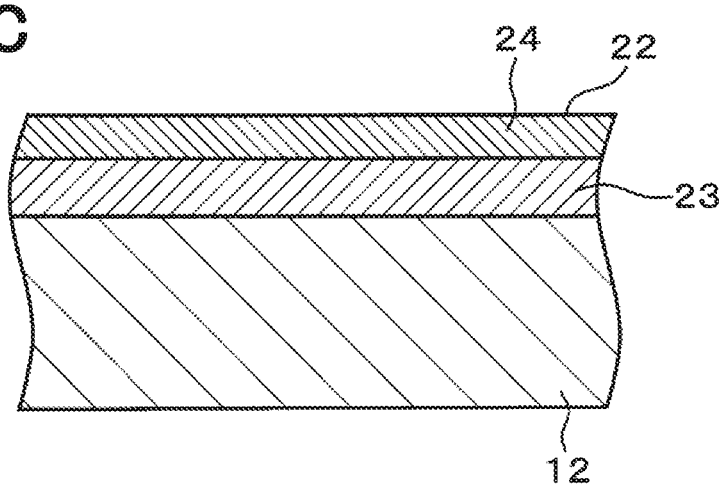
FIG. 10C is a diagram showing the manufacturing process of the press-fit terminal of the second comparative example after heat treatment is finished.

As a second comparative example, FIGS. 10A to 100 show an example in which a thick tin plating layer 22 is formed on the surface of the terminal base material 12 that has no recess. As shown in FIG. 100, when the heat treatment is completed, the tin alloy 23 is formed by the interdiffusion of the thin tin plating layer 22 and the base material, and a pure tin layer 24, which has not been alloyed, exists on the tin alloy 23. When the press-fit terminal having such a configuration is pressed into the through hole, the electrical connection is improved because the pure tin layer 24 is soft. However, there is a difficulty that the plating debris is generated.

As described above, in the present disclosure, the recess 16 is provided on the surface of the terminal insertion portion 15 of the press-fit terminal 11, and the plating surface treatment is performed so that the surface of the terminal insertion portion 15 including the recess 16 is smoothly covered without any depression. Thus, the tin plating layer 13 is provided. The recess 16 is provided in the region R1 on the surface of the terminal insertion portion 15. The region R1 is in contact with the inner surface of the through hole 9 of the copper plating layer 10.

The metal formed on the portion of the surface of the tin plating layer 13 corresponding to the recess 16 is softer than the metal that provides the copper plating layer 10 on the inner surface of the through hole 9. The metal formed on the portion of the tin plating layer 13 corresponding to the region other than the recess 16 is harder than the metal forming the copper plating layer 10 on the inner surface of the through hole 9. With this configuration, when the press-fit terminal 11 is press-fitted into the through hole 9, it is possible to reduce generation of the plating debris and to improve the electrical connection between the press-fit terminal 11 and the through hole 9. With this configuration, the press-fit terminal 11 can be easily manufactured.

Second Embodiment

Figure 11:
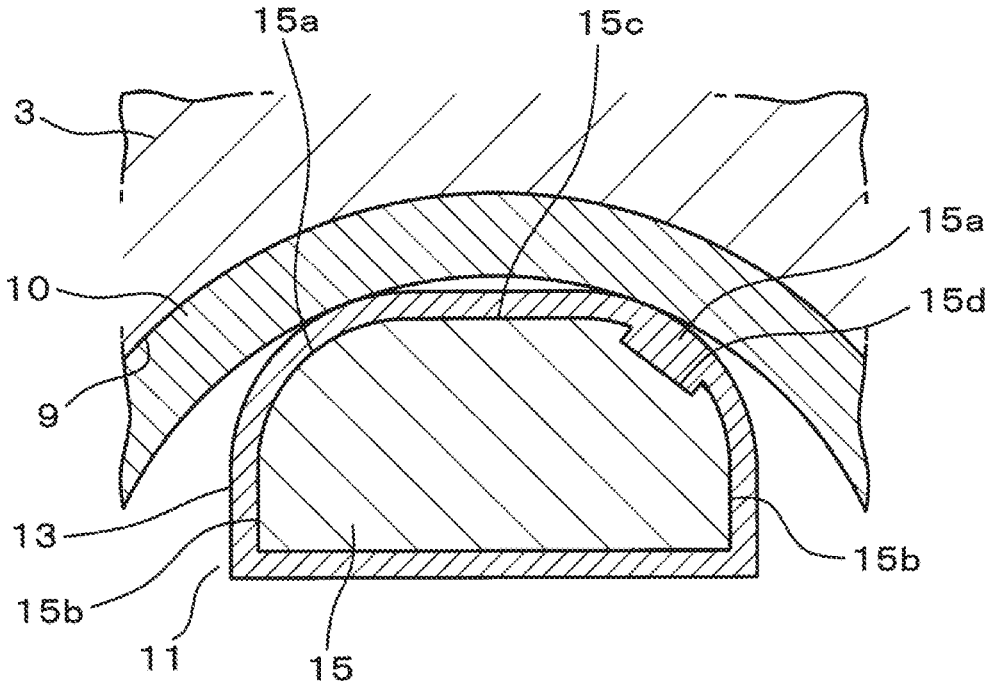
FIG. 11 is a cross-sectional view taken along line XI-XI in FIG. 2.

FIG. 11 shows the second embodiment, and is a cross-sectional view along the line XI-XI in FIG. 2. A configuration identical to that according to the first embodiment is denoted by an identical reference sign. In the second embodiment, a recess is also formed on a corner of the press-fit terminal 11 which is in contact with the through hole 9 when the press-fit terminal 11 is press-fitted into the through hole 9. Specifically, as shown in FIG. 11, in order not to break the copper plating layer 10 of the through hole 9, a round portion 15*a* that is an outer peripheral portion of the terminal insertion portion 15 of the press-fit terminal 11 and in contact with the through hole 9 is rounded. The terminal insertion portion 15 includes a first surface 15*b* and a second surface 15*c*. The second surface 15*c* is in contact with the through hole 9 when the press-fit terminal 11 is inserted into the insertion hole 9. The first surface 15*b* is connected to the second surface 15*c* through the round portion 15*a*. A recess 15*d* is formed in the round portion 15*a* having the rounded shape.

A method for manufacturing the press-fit terminal 11 having the above configuration will be described. First, the terminal base material 12 of the press-fit terminal 11 is punched by pressing a plate made of copper or a copper alloy. In this case, the corner portion of the outer peripheral portion of the terminal insertion portion 15 of the terminal base material 12 which contacts the through hole 9 has a sharp corner shape. In order not to brake the copper plating layer 10 of the through hole 9 when the press-fit terminal 11 is press fitted into the through hole 9, the corner portion is rounded as shown in FIG. 11.

The corner portion is formed to be punched by pressing a plate is crushed with, for example, a mold being pressed. The mold used in the chamfering has a smooth surface in order to increase the dimensional accuracy of the press-fit terminal 11. With this configuration, the surface of the rounded round portion 15*a* has a smooth surface. Thereafter, in the second embodiment, the recess 15*d* is formed in the rounded round portion 15*a*.

Configurations according to the second embodiment other than those described above are similar to corresponding configurations according to the first embodiment. The second embodiment thus achieves functional effect substantially same as that according to the first embodiment. In particular, according to the second embodiment, since the recess 15*d* is formed in the round portion 15*a* of the terminal insertion portion 15, a soft pure tin layer corresponding to the recess 15*d* can be formed in the tin plating layer 13 on the surface of the round portion 15*a*. Thus, when the press-fit terminal 11 is press-fitted into the through hole 9, the electrical connection can be further improved.

Third Embodiment

Figure 12:
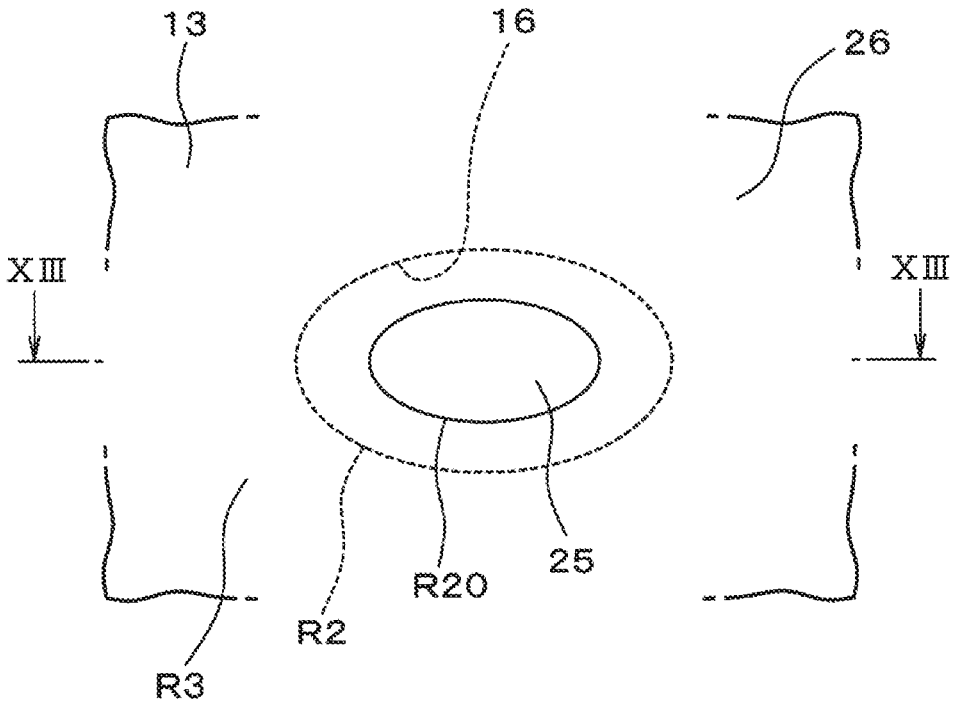
FIG. 12 is a partial view showing a surface of the terminal insertion portion of the press-fit terminal.
Figure 13:
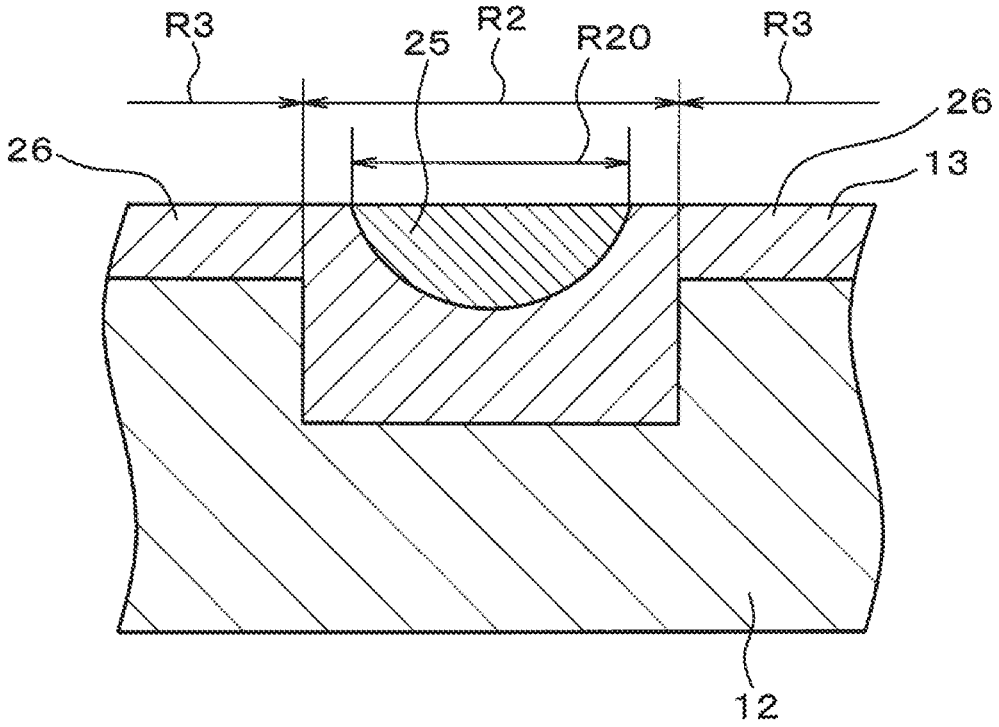
FIG. 13 is a cross-sectional view taken along line XIII-XIII in FIG. 12.

FIG. 12 and FIG. 13 show a third embodiment. A configuration identical to that according to the first embodiment is denoted by an identical reference sign. In the third embodiment, as shown in FIG. 13, the tin plating layer 13 of the press-fit terminal 11 is thick in the region R2 and thin in the region R3. In the region R2, the tin plating layer 13 is embedded in the recess 16. The region R3 is a region other than the region R2. As shown in FIG. 12, a tin plating layer 25 in a region R20 inside the region R2 is softer than the copper plating layer 10 in the through hole 9. In this case, the tin plating layer 25 may be formed of a tin plating layer made of pure tin. In the present embodiment, the tin plating layer 25 includes a metal having a lower melting point than the terminal base material 12, that is, pure tin. The tin plating layer 25 may include an alloy having a lower melting point than the terminal base material 12.

The tin plating layer 26 in a region other than the region R20 is harder than the copper plating layer 10 in the through hole 9. In this case, the tin plating layer 26 is provided by a tin plating layer made of a tin alloy such as an alloy of tin and copper or an alloy of tin and nickel.

Configurations according to the third embodiment other than those described above are similar to corresponding configurations according to the first embodiment. The third embodiment thus achieves functional effect substantially same as that according to the first embodiment.

Although the present disclosure has been described in accordance with the examples, it is understood that the disclosure is not limited to such examples or structures. The present disclosure encompasses various modifications and variations within the scope of equivalents. Furthermore, various combinations and formations, and other combinations and formations including one or more than one or less than one element may be included in the scope and the spirit of the present disclosure.

What is claimed is:

1. An electronic device comprising:

a circuit board;

a press-fit terminal inserted into a through hole of the circuit board, the press-fit terminal including a bar portion, and a press-fit deformation portion that is provided at an end of the bar portion, is wider than the through hole in a deformation direction, and is configured to be deformed when inserted into the insertion hole, a recess provided in the press-fit deformation portion and recessed from a surface of the press-fit deformation portion; and a terminal-side conductor layer that is a plating smoothly covering the surface of the press-fit deformation portion including the recess without depression, wherein:

the through hole has a through-hole-side conductor layer on an inner surface of the through hole;

the terminal-side conductor layer includes a second metal portion at a part corresponding to a region in which the recess does not exist; and the second metal portion is harder than a through-hole-side metal portion included in the through-hole-side conductor layer.

2. The electronic device according to claim 1, wherein:

the terminal-side conductor layer includes a first metal portion at a part corresponding to the recess; and the first metal portion is softer than the through-hole-side metal portion included in the through-hole-side conductor layer.

3. The electronic device according to claim 1, wherein the recess is located in a region of the surface of the press-fit deformation portion which is in contact with a through-hole-side conductor layer provided on an inner surface of the through hole.

4. The electronic device according to claim 1, wherein:

the press-fit deformation portion includes a first surface and a second surface;

the second surface is in contact with the through hole when the press-fit deformation portion is inserted into the insertion hole;

the first surface is connected to the second surface through a rounded surface; and the recess is provided on the rounded surface.

5. The electronic device according to claim 1, wherein:

a metal or an alloy included in a part of the terminal-side conductor layer corresponding to the recess has a lower melting point than a metal or an alloy of a base material of the press-fit terminal.

6. A press-fit terminal to be inserted into a through hole of a circuit board, the press-fit terminal comprising:

a bar portion, and a press-fit deformation portion that is provided at an end of the bar portion, is wider than the through hole in a deformation direction, and configured to be deformed when inserted into the insertion hole, a recess provided in the press-fit deformation portion and recessed from a surface of the press-fit deformation portion; and a terminal-side conductor layer that is a plating smoothly covering the surface of the press-fit deformation portion including the recess without depression, wherein:

the through hole has a through-hole-side conductor layer on an inner surface of the through hole;

the terminal-side conductor layer includes a second metal portion at a part corresponding to a region in which the recess does not exist; and the second metal portion is harder than a through-hole-side metal portion included in the through-hole-side conductor layer.

* * * * *